United States Patent [19]

O'Donnell

[11] 4,214,208

[45] Jul. 22, 1980

[54] JAMMING OF KEYED CONTINUOUS WAVE RADIO SIGNALS

[75] Inventor: Richard V. O'Donnell, Freehold, N.J.

[73] Assignee: The United States of America as represented by the Secretary of the Army, Washington, D.C.

[21] Appl. No.: 300,708

[22] Filed: Aug. 7, 1963

[51] Int. Cl.[2] ..... H04K 3/00

[52] U.S. Cl. ..... 455/1; 375/121

[58] Field of Search ..... 325/132, 22

[56] References Cited

U.S. PATENT DOCUMENTS 2,582,968 1/1952 Deloraine et al. ..... 325/132

*Primary Examiner*—Richard A. Farley

*Attorney, Agent, or Firm*—Nathan Edelberg; Sheldon Kanars; Jeremiah G. Murray

EXEMPLARY CLAIM

1. A jamming station for radiotelegraph signals comprising, a transmitter, said transmitter comprising an exciter, the output of said exciter being connected to the input of a power amplifier via a normally closed gate, the output of said power amplifier being connected to a duplex antenna; a receiver the input of said receiver being connected to said duplex antenna via a transmit-receive switch which is normally in the receive position, means to gang tune said receiver and transmitter to a radiotelegraph signal to be jammed, an automatic frequency control bias connected from said receiver to said exciter, an adjustable pulse generator having its input connected to the automatic gain control line of said receiver and arranged to generate a pulse at the end of each pulse of radio frequency in said radiotelegraph signal, the pulse output of said pulse generator being arranged to open said gate and to energize said transmit-receive switch, thereby causing said jammer to emit a pulse of radio frequency energy and to simultaneously disable said receiver, the duration of the pulse output of said pulse generator being adjusted to substantially fill in the gaps or spaces in said radiotelegraph signal, and means to monitor the output of said receiver.

1 Claim, 2 Drawing Figures

JAMMING OF KEYED CONTINUOUS WAVE RADIO SIGNALS

The invention described herein may be manufactured and used by or for the Government for governmental purposes without the payment of any royalty thereon.

This invention relates to a method and apparatus for jamming enemy radio transmissions and more particularly to a method and circuitry for rendering radio signals of the keyed continuous wave (CW) type unintelligible to the enemy while permitting the jamming station to read the enemy transmission. The conventional method of jamming keyed CW signals is to transmit another CW signal which is randomly keyed by the jammer. The speed of the random keying must be adjusted by the jammer operator to the approximate keying speed of the victim signal to be most effective. This of course prevents true random keying. Further, with this method of jamming the intelligence in the transmitted signal is made unavailable to friend and foe alike. These and other disadvantages are overcome in the method and apparatus of the present invention. Briefly stated, the present invention comprises a jamming transmitter which is automatically controlled by the victim signal in such a manner that the jamming transmitter goes on for a predetermined period each time that the victim signal goes off. Thus at the end of each dot, dash or mark in the enemy code transmission, the jamming transmitter would produce a pulse of RF approximately equal in length to the shortest space of said code transmission. Thus the jamming transmitter "fills-in" the spaces in the victim signal and masks the intelligence therein. The operation of the jamming transmitter is controlled by a jamming receiver. Since the transmitter is on only while the victim signal is off the receiver output will compromise the original unjammed enemy signal.

It is therefore an object of the present invention to provide a novel method and apparatus for jamming radiotelegraph signals.

It is another object to provide a novel jamming station in which the jamming transmitter is controlled by the victim signal.

It is a further object of this invention to provide a novel jammer for radiotelegraph signals which permits the jammer to read or monitor the victim signal.

Figure 1:
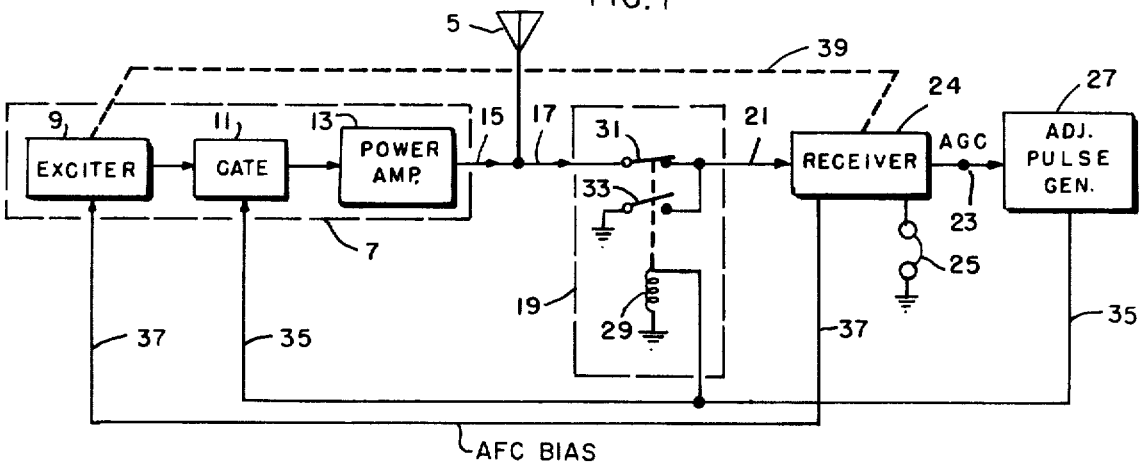
Figure 2:
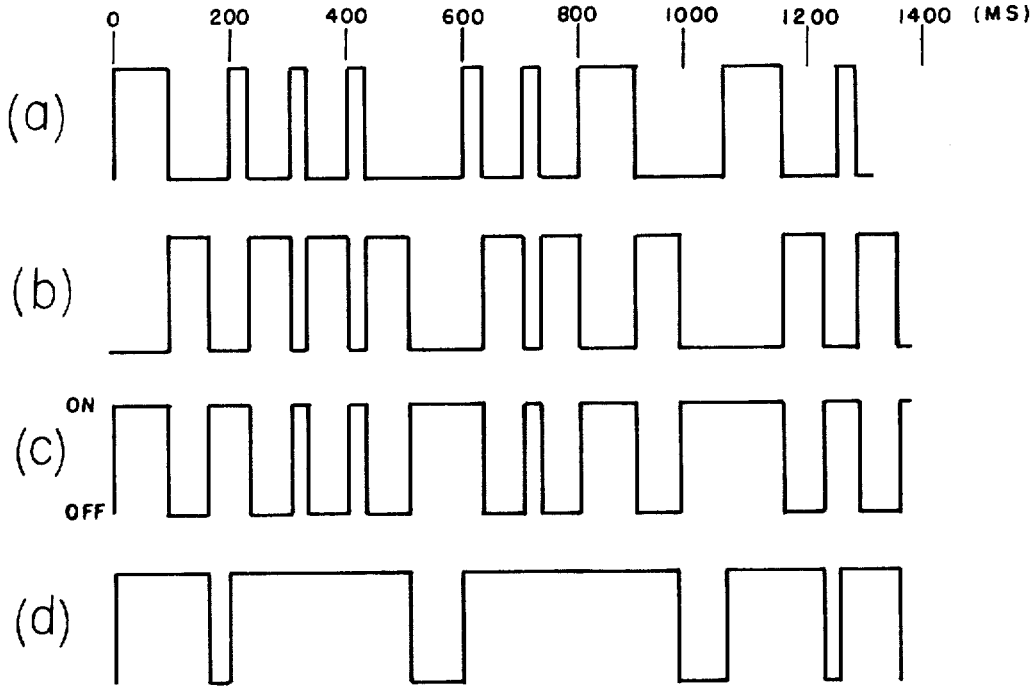

Other objects and advantages of this invention will become apparent from the following detailed description and drawings, in which:

FIG. 1 is a circuit diagram of a preferred embodiment of the apparatus of the present invention, and FIG. 2 is a series of waveforms illustrating the operation of the circuit of FIG. 1.

In FIG. 1 the duplex antenna 5 serves alternately as a transmitting and receiving antenna. The output of transmitter 7 is applied thereto via line 15 and received signals are applied to receiver 24 via line 17 and contact 31 of transmit-receive (T-R) switch 19. The T-R switch 19 is normally in the receive position as illustrated with coil 29 de-energized and contact 31 closed and 33 open. The automatic gain control (AGC) line of receiver 24 is applied to adjustable pulse generator 27 via line 23. The pulse output of 27 is applied to the coil 29 of T-R switch 19 and to gate 11 via line 35. An automatic frequency control (AFC) bias is fed from receiver 24 to transmitterexciter 9 via line 37. The headset 25 is connected to the output of receiver 24. In operation, the receiver 24 is tuned to an enemy code transmission and the exciter 9 automatically tracks the frequency of the receiver. This may be accomplished by gang tuning of the receiver and exciter as illustrated by the mechanical connection 39 with the AFC bias line 37 providing fine tuning. FIG. 2*a* shows the Morse Code representation of the letters BUN which will be assumed to be an enemy transmission to be jammed. The dashes are approximately 100 milliseconds (ms) in length, the dots 33 ms, with spaces of 100 ms following dashes, 66 ms following dots and 150 ms following each character. This timing corresponds to a transmission speed of 25 words per minute. The adjustable pulse generator 27 may constitute a mono-stable multivibrator which produces a pulse of predetermined duration at the end of each dot, dash or mark of the enemy signal. The AGC line of the receiver is used to initiate or trigger these pulses via line 23. Since the AGC voltage is usually negative, the pulse generator 27 would be arranged to be triggered only by positive-going portions of the AGC signal. Thus, at the end of each pulse of RF of the enemy signal, the receiver AGC voltage will rapidly change from some negative voltage to zero and trigger pulse generator 27. The output of the pulse generator is shown in FIG. 2*b*. With the particular transmission speed of 25 wpm illustrated in FIG. 2*a*, the pulse generator would be adjusted to produce a pulse of approximately 66 ms duration. These pulses are applied to the coil 29 of T-R switch 19 as well as to gate 11 via line 35. The energization of 29 opens contact 31 and closes 33, thereby disconnecting the receiver from antenna 5 and grounding the input 21 of the receiver. The application of each positive pulse from 27 to gate 11 opens or enables this gate and applies the output of exciter 9 to power amplifier 13 which in turn is connected to antenna 5. Following each pulse from 27 the gate 11 closes and coil 29 de-energizes, thus restoring the receiver to operation. FIG. 2*d* illustrates the resultant signal which would be received by an enemy receiving station. This waveform is the sum of FIGS. 2*a* and 2*b*. It can be seen that transmitted RF pulses of 66 ms duration are just sufficient to completely fill in the spaces between adjacent dots of the same character but do not completely fill in the spaces following dashes or following characters, however it can be seen that the composite signal of FIG. 2*d* bears little or no resemblance to the original transmission of FIG. 2*a* and would be unintelligible to the most skilled enemy receiving operator. FIG. 2*c* illustrates the periods during which the receiver 24 is on and off. It can be seen that the choice of the pulse duration of 27 allows the receiver to pick up each pulse of RF of the enemy signal. The enemy intelligence can therefore be monitored by means of the headset 25 or by means of recording equipment connected to the output of the receiver 24. The shorting of the input of receiver 24 by contact 33 during the operation of transmitter 7 prevents leakage of the transmitted signal to the receiver. In addition, the receiver should be well shielded to prevent stray pickup from the transmitter 7. Further, each pulse of the enemy transmission is available for continually adjusting the transmitted frequency to match the received enemy frequency. The T-R switch 19 has been illustrated as of the electromechanical type, however at higher transmission speeds it would be necessary to use a T-R switch with no moving parts, for example a solid state switch comprising transistors and diodes.

The invention has been illustrated in connection with the jamming of a Morse code radiotelegraph signal, however the circuitry may be used to jam any type of keyed CW signal, for example radioteletype signals, digital communications signals, coded navigation signals, or the like. In jamming radioteletype signals the pulse duration of the pulse generator 27 would be adjusted to the length of each bit which comprises the teletype signal. Since each of the five bits of each teletype character are of equal duration, the circuit of FIG. 1 would completely fill in the spaces of each teletype character. In jamming signals of the keyed modulated CW type, it would be necessary to modulate the exciter with the same audio tone which modulates the enemy signal.

While the invention has been illustrated in connection with a preferred embodiment it will be apparent that many modifications are possible without departing from the inventive concepts disclosed herein. Hence the invention should be limited only by the scope of the appended claims.

What is claimed is:

1. A jamming station for radiotelegraph signals comprising, a transmitter, said transmitter comprising an exciter, the output of said exciter being connected to the input of a power amplifier via a normally closed gate, the output of said power amplifier being connected to a duplex antenna; a receiver the input of said receiver being connected to said duplex antenna via a transmit-receive switch which is normally in the receive position, means to gang tune said receiver and transmitter to a radiotelegraph signal to be jammed, an automatic frequency control bias connected from said receiver to said exciter, an adjustable pulse generator having its input connected to the automatic gain control line of said receiver and arranged to generate a pulse at the end of each pulse of radio frequency in said radiotelegraph signal, the pulse output of said pulse generator being arranged to open said gate and to energize said transmit-receive switch, thereby causing said jammer to emit a pulse or radio frequency energy and to simultaneously disable said receiver, the duration of the pulse output of said pulse generator being adjusted to substantially fill in the gaps or spaces in said radiotelegraph signal, and means to monitor the output of said receiver.

* * * * *